United States Patent [19]

Gilljam et al.

[11] Patent Number: 4,702,433

[45] Date of Patent: Oct. 27, 1987

[54] COIL CARRIER

[75] Inventors: Hans N. Gilljam, Aachen; Manfred Chardon, Monchengladbach; Gregor Gebald, Korschenbroich-Pesch; Heinz-Peter Illig, Ubach-Palenberg, all of Fed. Rep. of Germany

[73] Assignee: Joseph Zimmermann, Aachen, Del.X

[21] Appl. No.: 862,601

[22] Filed: May 9, 1986

[30] Foreign Application Priority Data

May 10, 1985 [DE] Fed. Rep. of Germany ... 8514349[U]

[51] Int. Cl.[4] ..... B65H 75/18; B65H 75/20; B65H 75/24

[52] U.S. Cl. ..... 242/118.1; 242/118.11; 242/118.3

[58] Field of Search ..... 242/118.11, 118.1, 118.3, 242/118.31, 118.32; 68/189, 198

[56] References Cited

U.S. PATENT DOCUMENTS

| | | | |
|---|---|---|---|
| 3,465,984 | 9/1969 | Tigges et al. | 242/118.11 |
| 3,826,444 | 7/1974 | Hahm | 242/118.11 |
| 4,180,219 | 12/1979 | Becker et al. | 242/118.1 |
| 4,270,710 | 6/1981 | Ono | 242/118.11 |
| 4,272,037 | 6/1981 | Becker et al. | 242/118.1 |
| 4,331,305 | 5/1982 | Marquis et al. | 242/118.11 |
| 4,379,529 | 4/1983 | Nielsen | 242/118.11 |
| 4,402,474 | 9/1983 | Henning | 242/118.1 |
| 4,441,665 | 4/1984 | Hahm | 242/118.1 X |
| 4,598,880 | 7/1976 | Brutel et al. | 242/118.1 X |

FOREIGN PATENT DOCUMENTS

| | | | |
|---|---|---|---|
| 2755915 | 5/1979 | Fed. Rep. of Germany | 242/118.1 |
| 1416340 | 9/1965 | France | 242/118.1 |
| 251098 | 10/1948 | Switzerland | 242/118.1 |

*Primary Examiner*—Stanley N. Gilreath
*Attorney, Agent, or Firm*—Mason, Fenwick & Lawrence

[57] ABSTRACT

A coil carrier whose shell may be rigid (3; 20) or axially and/or radially compressible (37), has an end ring (1) and an upper ring (2). The upper ring (2) is provided with an axially projecting collar (14) which can be fitted inside the end ring (1) of an adjacent coil carrier of identical construction, at the same time leaving room for a thread reserve which is provided on the collar (14) and thus accommodated in a protected manner, particularly if coil carriers of this kind are placed axially one above the other and the coils located thereon are compressed axially. The measure by which the collar (14)of one coil can be inserted in an axially adjacent coil carrier can be determined by shoulders (9, 13) and extensions (10, 15). This measure can be determined in such a way that a thread can be fed from the thread reserve to a package to be produced or already present on the coil carrier, without becoming jammed.

19 Claims, 7 Drawing Figures

COIL CARRIER

The invention concerns a coil carrier for receiving yarns and the like, with an essentially cylindrical peripheral surface formed by supporting elements connected to each other after the fashion of a cage, which coil carrier comprises at one end a closed end ring with a radially inner covering surface, and at its other end a closed upper ring with an axially projecting collar.

In a known coil carrier of this kind (German Utility Model 84 16 028.4), there is provided a lower end ring which comprises a thread reserve groove in its radially outer surface. This end ring has a centering receptacle in which can engage a centering extension of an axially adjacent coil carrier. Due to cooperation between the centering receptacle of one coil carrier and the centering extension of the next, a sealing-tight coupling is thus formed between two coil carriers, which prevents undesirable passage of the dye liquor in the region of the adjoining coil carriers.

This known coil carrier, which is advantageous for many applications, has the disadvantage that the thread reserve in the thread reserve groove becomes covered during axial compression of the coils located on coil carriers which are disposed one above the other, and therefore during subsequent processing can no longer be located, or can be located only with special effort.

It is the object of the present invention, as opposed to this, to design a coil carrier which may be a rigid or axially and/or radially compressible coil carrier, in such a way that the thread reserve always remains freely accessible, even with axial displacement of the associated coil, particularly axial compression of coils arranged one above the other in a column.

According to the invention, this object is achieved in a coil carrier of the kind mentioned hereinbefore, by the fact that the collar, for receiving a thread reserve, has smaller radial external dimensions in one section, and the same or smaller radial external dimensions in the remainder, than the covering surface.

This coil carrier is particularly suitable for assembling yarn packages in a column on a dyeing spindle or stick, the dye liquor then being passed through the peripheral wall of the coil carriers and the coils located thereon. During axial compression the individual coils can abut against each other directly and thus form a column whose density and hence also flow resistance is homogeneous over the whole length. This kind of compression may however also be carried out solely or in addition for the purpose of facilitating unwinding of the coil, by reducing the angles of crossing produced during winding, by axial compression of the coils, so that the thread is displaced in an axial direction only relatively slightly during unwinding.

The shell with the peripheral surface formed thereby may have many kinds of embodiments. In particular, the shell can be in one piece and rigid. Also possible is a one-piece shell which is axially and/or radially compressible. Finally, the shell may also consist of two parts, so that it can be compressed altogether in an axial direction. With a two-piece shell of this kind too, radial compression is possible by itself or in addition.

With the coil carrier according to the invention, between the collar of one and the covering surface of the next there always remains a free space in which can be accommodated a thread reserve. This thread reserve is here protected by the covering surface, and therefore cannot be concealed by displacement of the yarn package itself during axial compression. The free space thus remaining between a collar and a covering surface can be provided with openings on one or two sides as desired, for exit and entry of a dye liquor, whereby on the one hand, dyeing of the thread reserve as well is made possible, but on the other hand uncontrolled passage of the dye liquors between two adjacent coil carriers is avoided.

The coil carrier according to the invention may be constructed in such a way that the collar is provided with a thread reserve groove. In this way a particularly well protected, precisely defined repository is produced for the thread reserve.

The coil carrier according to the invention may furthermore be constructed in such a way that the end ring has a thrust ring surface projecting radially outwards beyond the peripheral surface of the coil carrier. This ensures that during winding, a winding drum engages this end ring only, and not the elements of the peripheral surface which form the winding surface, and the first yarn layers wound thereon.

The coil carrier according to the invention may furthermore be constructed in such a way that the radially outer surface of the upper ring is matched to the peripheral surface. This may yield advantages, in particular with respect to mould technology.

The coil carrier according to the invention may furthermore be constructed in such a way that the axial width of the collar of the upper ring is greater than or equal to the width of the covering surface of the end ring. In this way a gap is produced between the collar on the one hand, and the end ring on the other hand, through which a yarn thread can be passed from the thread reserve to the package, and which cannot be eliminated during axial compression of the coil carriers and packages.

The coil carrier according to the invention may furthermore be constructed in such a way that the covering surface is defined by a radially inwardly projecting shoulder. In this way an exact measure can be preset, by which the collar of one coil carrier engages in the end ring of an axially adjacent coil carrier.

The coil carrier according to the invention may furthermore be constructed in such a way that the collar is defined by a radially outwardly projecting annular shoulder. In this way too, the correlation between any two adjacent coil carriers can be determined exactly.

The coil carrier according to the invention may furthermore be constructed in such a way that the covering surface is divided into an axially outer covering section, and a guide section offset radially inwards from the latter, and the radial external dimensions of the collar, at least in its portion projecting the furthest axially, are equal to or smaller than those of the guide section. In this way, axial guiding of adjacent coil carriers is ensured with the desired precision, without thereby impairing accommodation of the thread reserve in any way.

The coil carrier according to the invention may furthermore be constructed in such a way that the end ring is provided with rib extensions which start from the covering surface, being evenly distributed over the circumference, and whose inner surfaces extend radially inwards to an envelope. These rib extensions can serve to guide coil carriers which are fitted in each other, and can be suitably bevelled to facilitate introduction. They can moreover be used to limit insertion.

The coil carrier according to the invention may furthermore be constructed in such a way that the upper ring is provided with extensions which extend over a portion of the collar in an axial direction and are evenly distributed over the circumference and whose outer surfaces extend to an envelope whose radial dimensions are equal to or smaller than those of the covering surface. Here, the thread reserve is located in front of the extensions on the collar.

The coil carrier according to the invention may furthermore be constructed in such a way that the axial dimension of the extensions of the upper ring is smaller than the axial dimension of the rib extensions of the end ring.

Finally, the coil carrier according to the invention may be constructed in such a way that the number of extensions of the upper ring is equal to that of the rib extensions of the end ring. When such coil carriers are placed axially one above the other, one rib extension comes to lie between every two extensions, and vice versa.

In the following part of the specification, some embodiments of the coil carrier according to the invention are described with reference to drawings.

Figure 4:
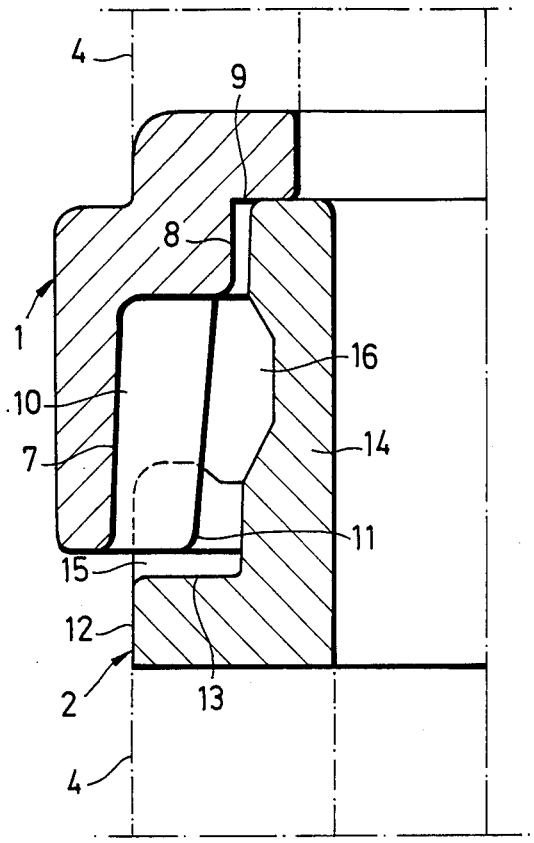
Figure 5:
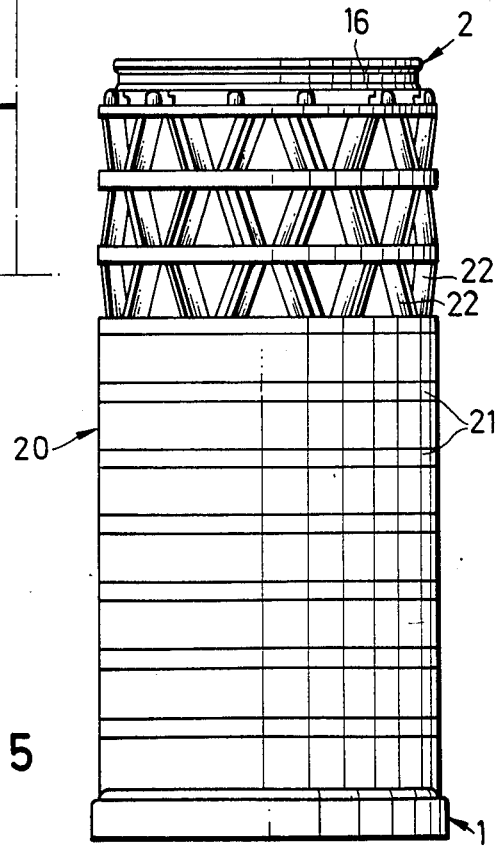
Figure 6:
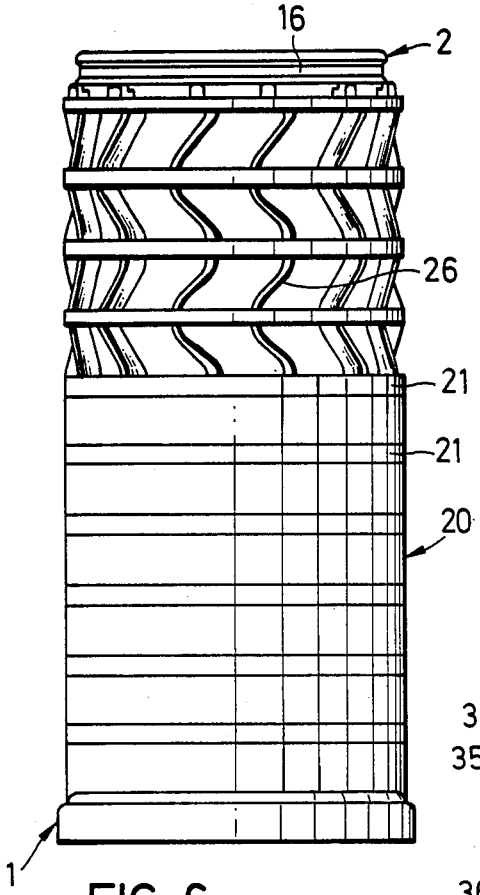
Figure 7:
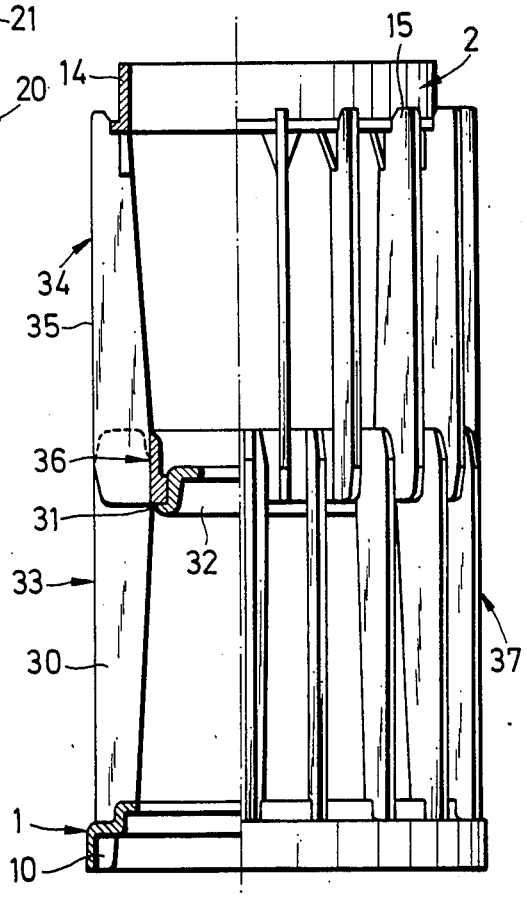

FIG. 4 shows a partial section through the nesting parts of two axially adjacent coil carriers according to the invention, and FIG. 5 shows a side view of another embodiment of the coil carrier according to the invention, FIG. 6 shows a side view of another embodiment of the coil carrier according to the invention, and FIG. 7 shows a side view of another, two-part embodiment of the coil carrier according to the invention.

Figure 3:
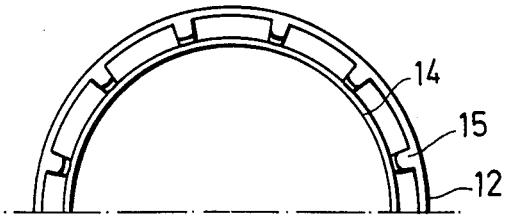
FIG. 3 shows a bottom view of a portion of the coil carrier in FIG. 1
Figure 1:
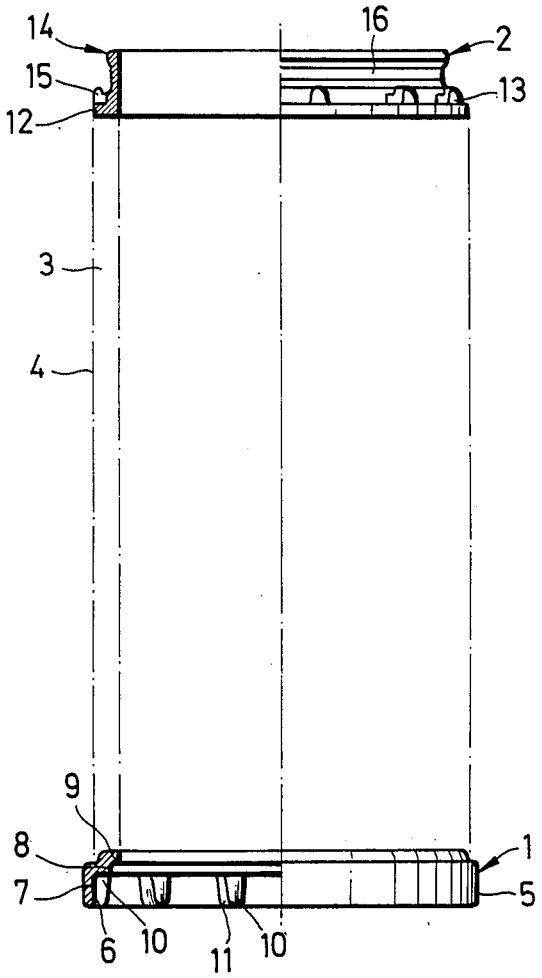
FIG. 1 shows a coil carrier constructed according to the invention as in a first embodiment, in side view and partially in section.
Figure 2:
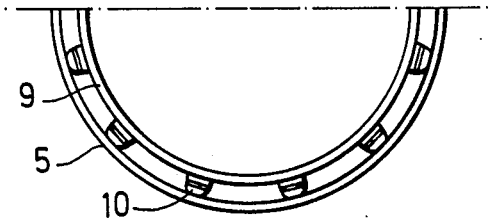
FIG. 2 shows a plan view of a portion of the coil carrier in FIG. 1

The coil carrier according to the invention as in FIGS. 1–3 has an end ring 1 at one end and an upper ring 2 at its other end. Between these two rings 1, 2 is located a shell 3 with a peripheral surface 4 onto which yarn can be wound in the form of a package, not shown.

The shell 3 shown in dot-dash lines in FIG. 1 can be constructed as a unit which is essentially rigid, or axially and/or radially compressible.

The end ring 1 has a thrust ring surface 5 which is cylindrical in the practical example and which is offset radially outwards from the peripheral surface 4. The inner side of the end ring 1 is defined essentially by a covering surface 6 which is divided into a covering section 7 and a guide section 8. The covering section 7 is located at the axially outer end of the covering surface 6. Adjoining this covering section 7 and offset radially inwards is the guide section 8, which is adjoined by an inwardly projecting shoulder 9. In the region of the covering section 7 of the end ring 1 are provided rib extensions 10 which are evenly distributed over the circumference. The rib extensions 10 slope up towards the shoulder 9 in their radial direction. They have rounded corners 11.

The upper ring 2 at the other end of the coil carrier has an outer surface 12 which is located in the peripheral surface 4. Adjoining this outer surface 12 is first a shoulder 13, and then an axially projecting collar 14 with a smaller outside diameter than the outer surface 12. A plurality of equidistantly spaced axial extensions 15 in the form of finger lugs extend upwardly from shoulder 13 and radially outward from collar 14.

The outside diameter of the collar 14 is not more than that of the smallest envelope to which extend the radially inner edges of the rib extensions 10. Furthermore, the collar 14 has a thread reserve groove 16 with a further reduced outside diameter. The rib extensions 10 and the extensions 15 are evenly distributed over the circumference. The number of rib extensions 10 corresponds to that of the extensions 15. The axial length of the rib extensions 10 is greater than that of the extensions 15.

The collar 14 of a coil carrier of the kind described can be inserted in the end ring 1 of an axially adjacent coil carrier, each extension 15 coming to lie between rib extensions 10. The collar 14 extends as far as a point inside the guide section 8 of the end ring 1, and abuts against the shoulder 9 there. In the thread reserve groove 16 can be accommodated, in a protected manner, a thread reserve from which a thread can be fed through between the extensions 15 and the rib extensions 10, to the package which is located on the coil carrier.

In FIG. 4 is shown the end ring 1 of one (upper) coil carrier, and the upper ring 2 of one (lower) coil carrier. This drawing makes its particularly clear that in the position mounted one on top of the other, the free end of the collar 14 abuts against the shoulder 9 of the end ring 1. The thread reserve groove 16 of the collar 14 is covered by the end ring 1; here, between the axially outer end of the end ring 1 on the one hand, and the shoulder 13 or outer surface 12 of the upper ring 2 on the other hand, there remains a gap through which a thread can be fed from the thread reserve groove 16 to a package, not shown, which is formed on the peripheral surface 4 or disposed there.

In FIG. 5 is shown an embodiment of the coil carrier according to the invention, which has a shell 20 comprising rings 21 which are connected to each other by struts 22 which are at an angle to the axial direction. This shell 20 provides an essentially rigid coil carrier with an end ring 1 and an upper ring 2 as in FIGS. 1–4.

The embodiment of the coil carrier according to the invention which is shown in FIG. 6 differs from the one as in FIG. 5 only in that between the rings 21 are disposed approximately S-shaped struts 26 which are deformed when axial pressure is applied to the coil carrier, and thus make the coil carrier axially compressible. The coil carrier according to FIG. 6 also has an end ring 1 and an upper ring 2, as described with reference to FIGS. 1–4.

FIG. 7 shows a coil carrier consisting of two parts, with an end ring 1 and an upper ring 2. From the end ring 1 extend rod-like supporting elements 30 with parallel axes, which are connected at their ends by preset breaking points 31 to an inner locking ring 32. Thus a base portion 33 of the coil carrier is formed.

The coil carrier according to FIG. 7 has a head portion 34 with an upper ring 2 from which extend supporting elements 35, which are connected at their inner edges to a support ring 36 in the region of the axial center of the coil carrier. The support ring 36 engages in the locking ring 32.

The supporting elements 30 and 35 form a shell 37. When axial pressure is applied to the end ring 1 or the upper ring 2, the locking ring 32 breaks away from the supporting elements 30, and base portion 33 and head portion 34 are telescoped together to achieve axial shortening. At the same time the shell 37 may be radially compressible as well.

Particularly suitable for manufacture of the coil carrier according to the invention in its various embodiments is thermoplastic synthetic material, which can be used in each case in the desired color.

We claim:

1. A stackable coil carrier which can be matingly stacked with like coil carriers, said coil carrier including an essentially cage-like shell means having first and second ends and a generally cylindrical peripheral surface for receiving a wrapping of yarn or the like, a first end ring attached to the first end of said cage-like shell means and including a generally cylindrical covering section having an inner surface, a second end ring attached to the second end of said cage-like shell means and including an outer surface and an axially projecting collar, said axially projecting collar further including a circular thread reserve groove extending inwardly from the outer surface of said axially projecting collar and said axially projecting collar having an outer surface having a smaller diameter than the diameter of said inner surface of said cylindrical covering section so that said thread reserve always remains accessible when the collar is positioned within the confines of a cylindrical cover section of another of said coil carriers.

2. A coil carrier as recited in claim 1 wherein said inner surface of said covering section of said first end ring has a greater diameter than the outer diameter of said essentially cage-like shell means.

3. A coil carrier as recited in claim 2 wherein said outer surface of said second end ring has approximately the same diameter as the outer peripheral surface of said cage-like shell means.

4. A coil carrier as recited in claim 3 additionally, including radially inwardly extending shoulder means extending inwardly of said first end ring and a guide section extending radially between an upper portion of said covering section and said shoulder means and terminating in an inner generally cylindrical surface.

5. A coil carrier as recited in claim 4 additionally including radially outwardly extending shoulder means extending outwardly from said axially projecting collar of said second ring means.

6. A coil carrier as recited in claim 5 wherein the outer diameter of said collar is no greater than the diameter of said inner generally cylindrical surface of said guide section.

7. A coil carrier as recited in claim 6 wherein additionally including a plurality of equidistantly spaced rib extensions extending radially inwardly from said cover section.

8. A coil carrier as recited in claim 7 additionally including a plurality of equidistantly spaced axially extending finger lugs extending upwardly from said shoulder means and radially outwardly from said collar means and wherein the outer radial extent of said finger lugs is inward of the radial position of said inner surface of said covering section.

9. A coil carrier as recited in claim 8 wherein said finger lugs have an axial dimension that is less than the axial dimension of said rib extensions.

10. A coil carrier as recited in claim 9 wherein these are equal numbers of rib extensions and finger lugs.

11. A coil carrier as recited in claim 1 wherein said outer surface of said second end ring has approximately the same diameter as the outer peripheral surface of said cage-like shell means.

12. A coil carrier as recited in claim 11 additionally, including radially inwardly extending shoulder means extending inwardly of said first end ring and guide section extending radially between an upper portion of said covering section and said shoulder means and terminating in an inner generally cylindrical surface.

13. A coil carrier as recited in claim 12 additionally including radially outwardly extending shoulder means extending outwardly from said axially projecting collar of said second ring means.

14. A coil carrier as recited in claim 13 wherein the outer diameter of said collar is no greater than the diameter of said inner generally cylindrical surface of said guide section.

15. A coil carrier as recited in claim 6 wherein additionally including a plurality of equidistantly spaced rib extensions extending radially inwardly from said cover section.

16. A coil carrier as recited in claim 15 additionally including a plurality of equidistantly spaced axially extending finger lugs extending upwardly from said shoulder means and radially outwardly from said collar means and wherein the outer radial extent of said finger lugs is inward of the radial position of said inner surface of said covering section.

17. A coil carrier as recited in claim 16 wherein said finger lugs have an axial dimension that is less than the axial dimension of said rib extensions.

18. A coil carrier as recited in claim 17 wherein there are equal numbers of rib extensions and finger lugs.

19. A coil carrier as recited in claim 16 wherein there are equal numbers of rib extensions and finger lugs.

* * * * *

US004702433B1

REEXAMINATION CERTIFICATE (3280th)

United States Patent [19]

Gilljam et al.

[11] B1 4,702,433

[45] Certificate Issued Jul. 22, 1997

[54] COIL CARRIER

[75] Inventors: Hans N. Gilljam, Aachen; Manfred Chardon, Monchen Gladbach; Gregor Gebald, Korschenbroich-Pesch; Heinz-Peter Illig, Ubach-Palenberg, all of Germany

[73] Assignee: Technimark, Inc., Asheboro, N.C.

Reexamination Request:
No. 90/004,501, Dec. 23, 1996

Reexamination Certificate for:

| | |
|---|---|
| Patent No.: | **4,702,433** |
| Issued: | **Oct. 27, 1987** |
| Appl. No.: | **862,601** |
| Filed: | **May 9, 1986** |

[30] Foreign Application Priority Data

May 10, 1985 [DE] Germany ..... 8514349 U

[51] Int. Cl.[6] ..... B65H 75/18; B65H 75/20; B65H 75/24

[52] U.S. Cl. ..... 242/118.1; 242/118.11; 242/118.3

[58] Field of Search ..... 242/118.1, 118.11, 242/118.3, 118.31, 118.32; 68/189, 198

[56] References Cited

FOREIGN PATENT DOCUMENTS 56-52828 12/1981 Japan .

*Primary Examiner*—Michael R. Mansen

[57] ABSTRACT

A coil carrier whose shell may be rigid (3; 20) or axially and/or radially compressible (37), has an end ring (1) and an upper ring (2). The upper ring (2) is provided with an axially projecting collar (14) which can be fitted inside the end ring (1) of an adjacent coil carrier of identical construction, at the same time leaving room for a thread reserve which is provided on the collar (14) and thus accommodated in a protected manner, particularly if coil carriers of this kind are placed axially one above the other and the coils located thereon are compressed axially. The measure by which the collar (14)of one coil can be inserted in an axially adjacent coil carrier can be determined by shoulders (9, 13) and extensions (10,15). This measure can be determined in such a way that a thread can be fed from the thread reserve to a package to be produced or already present on the coil carrier, without becoming jammed.

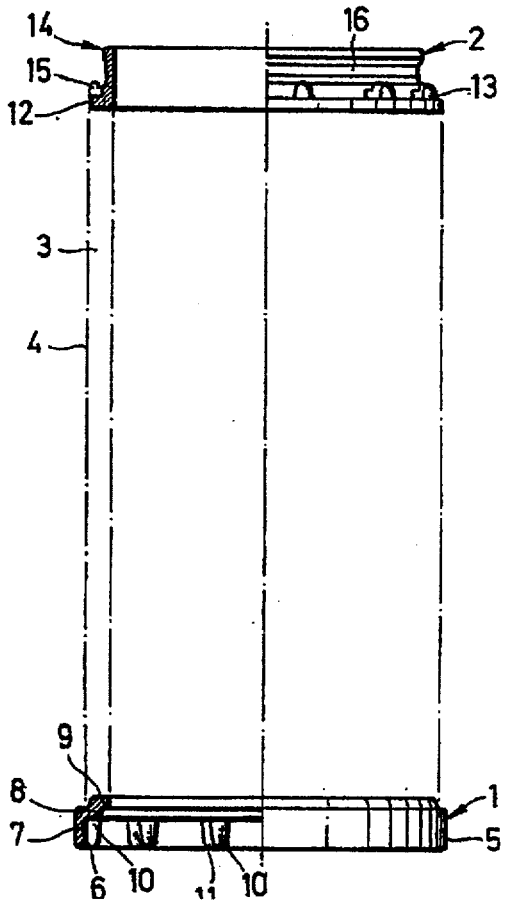

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *